US012371801B1

(12) United States Patent
Tsybulski

(10) Patent No.: US 12,371,801 B1
(45) Date of Patent: Jul. 29, 2025

(54) ELECTROLYTIC SYNTHESIS OF COPPER(I) CHLORIDE AND COPPER(II) CHLORIDE

(71) Applicant: Mark Tsybulski, Brooklyn, NY (US)

(72) Inventor: Mark Tsybulski, Brooklyn, NY (US)

( * ) Notice: Subject to any disclaimer, the term of this patent is extended or adjusted under 35 U.S.C. 154(b) by 25 days.

(21) Appl. No.: 18/900,797

(22) Filed: Sep. 29, 2024

Related U.S. Application Data

(60) Provisional application No. 63/668,191, filed on Jul. 6, 2024, provisional application No. 63/665,575, filed on Jun. 28, 2024.

(51) Int. Cl.
*C25B 1/00* (2021.01)
*C25B 1/24* (2021.01)

(52) U.S. Cl.
CPC ..... *C25B 1/24* (2013.01)

(58) Field of Classification Search
CPC ..... C25B 1/24
See application file for complete search history.

(56) References Cited

U.S. PATENT DOCUMENTS 2,552,753 A * 5/1951 Von Schulthess ..... C25C 7/04 204/266
2018/0245223 A1* 8/2018 Self ..... C07C 17/08

* cited by examiner

*Primary Examiner* — Zulmariam Mendez

(57) ABSTRACT

Copper(I) chloride and Copper(II) chloride are commonly used industrial chemicals. A new process of synthesizing CuCl, with $CuCl_2$ as a byproduct, is disclosed. This process emits significantly less greenhouse gasses than existing methods and does not require fossil fuels. It involves electrolysis of Sodium chloride solution with a copper anode in order to precipitate out CuCl and $Cu_2O$, which are then both placed into HCl in order to convert the $Cu_2O$ into CuCl and dissolve any $Cu^{2+}$ impurities in the CuCl. The resulting pure CuCl precipitate is then extracted. $CuCl_2$ is obtained by filtering out the precipitate that results from saturating the supernatant from electrolysis with NaCl. This process emits only 2.6 grams of $CO_2$ per gram of CuCl produced using renewable energy, compared to today's most used industrial method, which emits over 5.9 grams of $CO_2$ per gram of CuCl and requires fossil fuels.

17 Claims, 3 Drawing Sheets

Electrolysis Setup and Reactions

Electrolysis Setup and Reactions

Removal of Impurities Over the Course of the Process

**GHG Emissions by Source*: Main Industrial Method^ vs Proposed Method (not counting byproduct recovery)**

**GHG Emissions*: Proposed Method vs Theoretical Future Method^ vs Main Industrial Method^**

*Emissions from comparable sources not counted (e.g. transport of materials).

ELECTROLYTIC SYNTHESIS OF COPPER(I) CHLORIDE AND COPPER(II) CHLORIDE

CROSS-REFERENCE

Provisional Patent Application No. 63/668,191 Filing or 371(c) date 07/06/2024, Title: Electrolytic Synthesis of Copper(I) Chloride and Copper(II) Chloride Provisional Patent Application No. 63/665,575 Filing or 371(c) date 06/28/2024, Title: Electrolytic Synthesis of Copper(I) Chloride

FEDERAL SPONSORSHIP

N/A

LARGE TABLES

N/A

BACKGROUND

Copper(I) chloride is an industrially important chemical with many different uses, and the market for it generates hundreds of millions of dollars every year. One of its major uses is as a catalyst in organic reactions; the most important reaction it catalyzes is the Sandemyer reaction, which produces chlorobenzene, an industrially important organic solvent, degreaser, and precursor to other chemicals. Another major use of CuCl is as a precursor for the production of Dicopper Chloride Trihydroxide, which is used as a fungicide, pigment, and catalyst. The compound, CuCl also has more niche uses, such as atom transfer radical polymerization (ATRP).

There are different ways to produce Copper(I) chloride, which have been employed. For example, it was first synthesized in 1666 using a reaction of Mercury chloride and metallic copper that is no longer used because it is inefficient and uses toxic chemicals. Other methods include the reduction of CuCl2 via SO2, and a comproportionation reaction involving CuCl2 and organic solvents. These and other methods release significantly more GHGs than today's common industrial approach (that in this paper will be called the Main Industrial Method) because they require materials produced directly from coal and oil. Because of this, and the fact that they require less specialized equipment, they are mainly used in the laboratory rather than at large scale.

The Main Industrial Method works by melting copper and directly combining it with chlorine gas while molten. The reaction vessel is usually made of temperature and corrosion resistant nickel alloys and heated using natural gas. The main benefit of this process is a complete reaction with few impurities, however, significant amounts of CO2 are emitted from extraction and burning of natural gas. Although it is less polluting than other methods, the Main Industrial Method still releases over 5.9 grams of CO2 per 1 gram of CuCl produced (due to the lack of information, this calculation assumes 100% efficiency in heating and 100% yield, does not include emissions from the purification process, etc. which means that emissions in reality are significantly higher than calculated above) [FIG. 3].

The Problem:

Considering the destructive effect of greenhouse gasses on the environment, the finite amount of fossil fuels, and the amount of Copper(I) chloride produced every year, finding a more sustainable way to produce Copper(I) chloride is very important.

BRIEF SUMMARY

Solution to the Problem

To address the aforementioned problem, a new method has been developed (that in this paper will be called the Proposed Method). This method uses electrolysis, filtration, and subsequent chemical purification to produce Copper(I) chloride.

Advantageous Effects of Invention

The Proposed Method has the capability to run fully on renewable energy and releases over 2.25 times less GHGs (based on experimental data from the development of this invention) than the Main Industrial Method [FIG. 3]. Converting large scale production of CuCl to the Proposed Method would decrease CO2 emissions as well as conserve more fossil fuels to be used where they cannot be replaced.

The Process:

The Proposed Method, at small scale, involves electrolysis with a Copper anode and Graphite cathode in 60 mL of 2M NaCl solution, to which 0.6 watts (12 V, 0.05 A) of electricity are applied for 4 hours at room temperature (~28° C.). [FIG. 1]. During this time, the following reaction sequences (relating to CuCl synthesis) take place:

At the anode:

$$[Cu_{(s)}+\text{energy}\rightarrow Cu^{+}_{(aq)}+e^{-};\ Cu_{+(aq)}+Cl^{-}_{(aq)}\rightarrow CuCl_{(s)}]$$

$$[Cu_{(s)}+\text{energy}\rightarrow Cu^{+}_{(aq)}+e^{-};\ 2Cu^{+}_{(aq)}+O_{2}^{-}{}_{(aq)}\rightarrow Cu_{2}O_{(s)}]$$

At the cathode (with the exception of the first reaction, which takes place at the anode):

$$[Cu_{(s)}+\text{energy}\rightarrow Cu^{2+}_{(aq)}+2e^{-};\ Cu^{2+}_{(aq)}+e-\rightarrow Cu^{+}_{(aq)};\ Cu^{+}(aq)+Cl^{-}_{(aq)}\rightarrow CuCl_{(s)}].$$

Another reaction taking place is the formation of hydrogen on the cathode, which at large scale production will be a beneficial byproduct.

After 4 hours of electrolysis, the supernatant is separated from the precipitates by filtration, and the precipitates are placed into 50 mL of 0.1M HCl and stirred. The HCl dissolves Cu2+ impurities and converts $Cu_2O$ into CuCl as shown: $[Cu_2O_{(s)}+2HCl_{(aq)}\rightarrow 2CuCl_{(s)}+H_2O_{(l)}]$. Similarly to the electrolysis step, the HCl with dissolved impurities is removed by filtration and the now purified CuCl is dried. The supernatant that was removed earlier can be saturated with NaCl to precipitate out $CuCl_2$, which can be collected by filtration.

The Proposed Method was tested on a small scale, however it is easily scalable to the industrial level.

DETAILED DESCRIPTION

Figure 3:
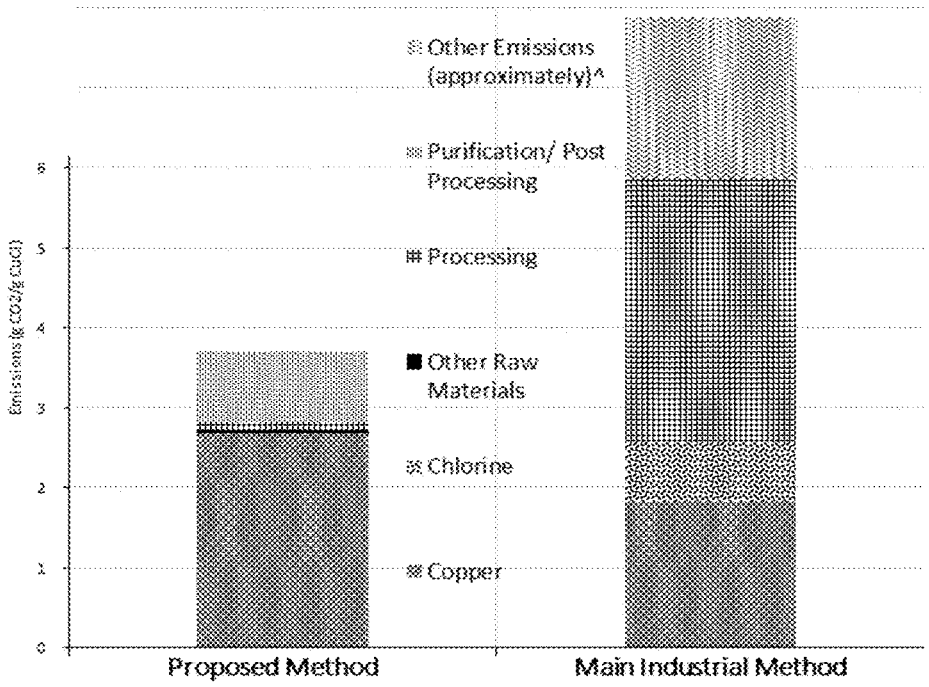
FIG. 3: two graphs comparing GHG emissions of this invention (Proposed Method) and other methods.
Figure 3:
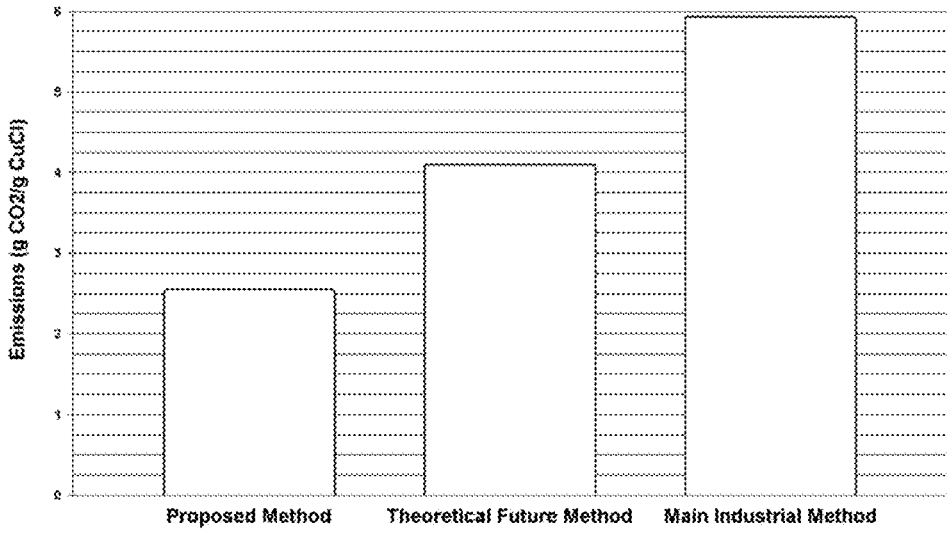

To address the problem of GHG emissions from Copper (I) chloride production, the Proposed Method, which uses electrolysis, filtration, and subsequent chemical purification to produce Copper(I) chloride, was developed. Its main advantage is the capability to run fully on renewable energy and release over 2.25 times less GHGs than the Main Industrial Method [FIG. 3].

To electrolytically synthesize CuCl at small scale, the materials used are distilled water, sodium chloride, copper metal, a graphite rod, a power supply, crocodile clip wires, a timer, 0.1M HCl, a 50 mL sidearm flask, a tube, 0.22 μm nylon membrane filters, a scale, a Büichner funnel, and a 150 mL syringe.

Figure 1:
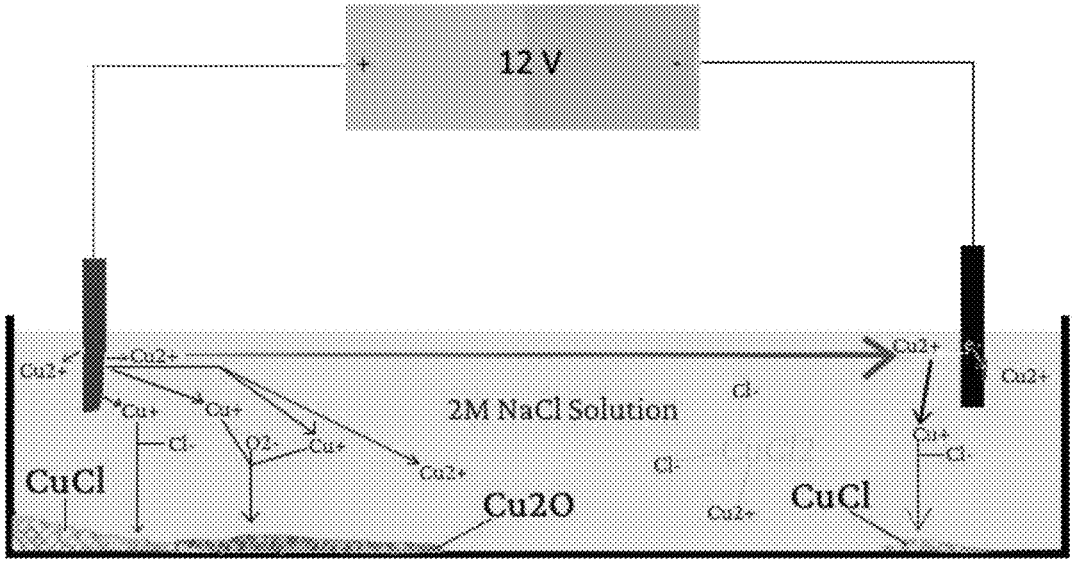
FIG. 1: a diagram of the electrolysis setup and reactions.

The first step of the process is to measure out 60 mL of distilled water and 7 g of sodium chloride. The solution is then electrolyzed at 12 V and 0.05 A for 4 hours at room temperature (~28° C.) [FIG. 1]. The result is a mixture consisting of solid CuCl and Cu2O; dissolved CuCl2 and NaCl; and liquid water.

The potential reactions along with their reduction potentials are shown below (all ions are in aqueous solution):

Cu+1+e−→Cu(s) +0.52 V

Cu+2+2e−→Cu(s) +0.34 V

Cu+2+e−→Cu+1 +0.15 V

Cl2(g)+2e−→2Cl−+1.36 V

O2(g)+4H++4e−→2H2O(l) +1.23 V

2H++2e−→H2(g) 0.00 V

Na++e−→Na(s) −2.71 V

The generation of O2 gas is thermodynamically favored over the generation of Cl2 gas, and the generation of Cu+2 is thermodynamically favored over that of Cu+1. However, since there is a large overpotential applied of 12 V, a mixture of products is formed. The low $K_{sp}$ of CuCl coupled with the relative thermodynamic unfavorability of oxidation of Cl− in the presence of H2O may favor Cu+1 consumption into the formation of CuCl before it can be converted to Cu+2

After electrolysis, the mixture is filtered using a 0.22 μm nylon membrane and 50 mL of 0.1M HCl is added to the precipitates to dissolve Cu2+ impurities and convert Cu2O to CuCl. After stirring the mixture for approximately 40 minutes and waiting for the precipitates to turn a uniform light green color (signifying complete conversion), the supernatant is removed by filtration using a 0.22 μm nylon membrane, and the now purified CuCl is dried. In total, 0.84 g of CuCl is produced.

Copper(II) chloride and unreacted NaCl can be recovered by saturating the supernatant from electrolysis with NaCl. This would cause precipitation of CuCl2, which could then be filtered.

Figure 2:
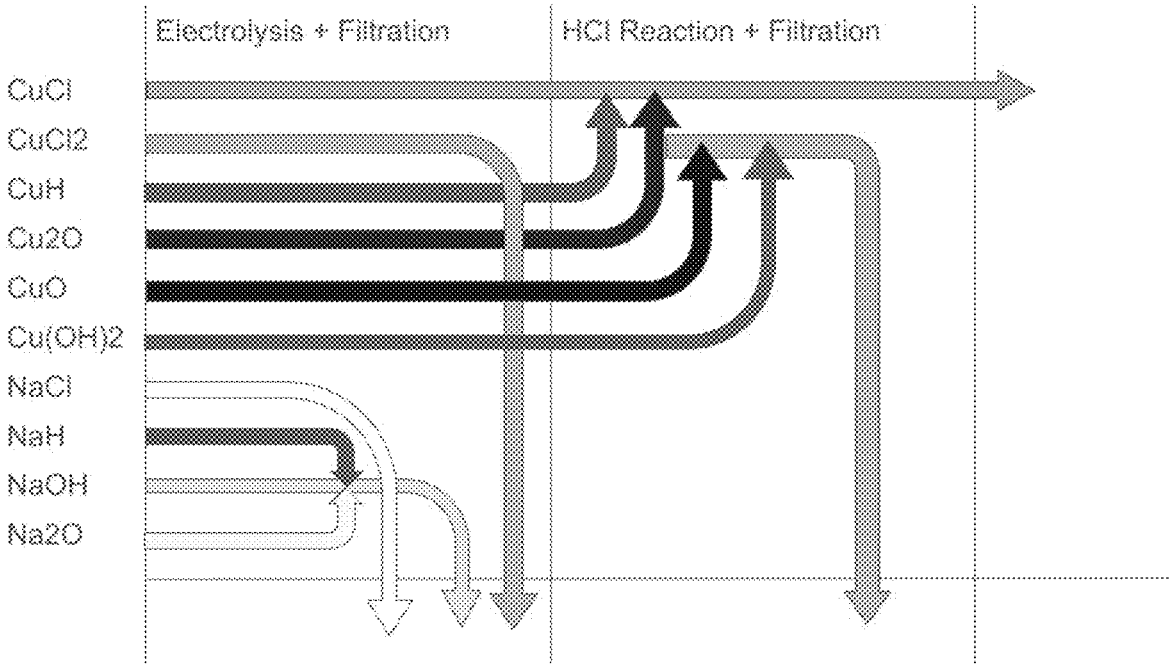
FIG. 2: a flowchart showing the removal of impurities over the course of the process

In the Proposed Method, the only elements present in the electrolysis reaction are Cu, Na, Cl, H, and O, meaning the only salts that theoretically could have formed (disregarding reduction potentials) are CuCl, CuCl2, CuH, CuO, Cu2O, Cu(OH)2, NaCl, NaH, NaOH, and Na2O. NaH and Na2O could not have formed because they quickly react with water to form NaOH. CuCl2*, NaCl, and NaOH cannot be present in the final product since they are water soluble and are left in the supernatant after removal of the precipitate from electrolysis. Cu2O and CuH cannot be present in the final product because they react with HCl to form CuCl, and Cu(OH)2 and CuO cannot be present in the final product because they react with HCl to form CuCl2*, which dissolves and is removed with the supernatant during filtration. As a result, CuCl is the only compound that can be present after electrolysis, purification with HCl, and filtration after both steps [FIG. 2].

CuCl2 reforms in trace amounts upon contact of CuCl with humid air.

The product's identity was confirmed using an oxidation-reduction (redox) titration, which is a widely used method of measuring the concentration of a dissolved substance amenable to being reduced or oxidized. The materials used are Ferric Ammonium Sulfate (NH4Fe(SO4)2), 6 N Sulfuric Acid (H2SO4), Potassium Permanganate (KMnO4), a burette, and a conical flask. Two solutions are made, the first with 2.5 g $NH_4Fe(SO_4)_2$ in 25 mL of 6N $H_2SO4$, and the second with $KMnO_4$ in water diluted to 0.1M. The product was dissolved in the sulfuric acid solution and then titrated with the 0.1M potassium permanganate solution until the color changed from green to brown.

During the titration, $Fe^{3+}$ was reduced to $Fe^{2+}$ by the $Cu^{+}$ in acidic medium, which in turn was oxidized to $Cu^{2+}$ according to the following equation $$[Cu^{+}+Fe^{3+}\rightarrow Cu^{2+}+Fe^{2+}]$$

Then the $Fe^{2+}$ was oxidized back to $Fe^{3+}$ by $Mn^{7+}$ in acidic medium, which in turn was reduced to $Mn^{2+}$ according to the following equation $$[MnO_4-8H^{+}+5Fe^{+2}\rightarrow 5Fe^{+3}+Mn^{+2}+4H_2O]$$

Multiplying the first equation by 5 and adding to the second equation yields the effective ionic equation $$[MnO_4^{-1}+8H^{+}+5Cu^{+}\rightarrow 5Cu^{+2}+Mn^{+2}+4H_2O]$$

1 mole of $MnO4^{-1}$ is hence required to neutralize 5 moles of $Cu^{+}$5.8 mL of the potassium permanganate solution was used to titrate 0.297 g of the sample. 5.8 mL of 0.1M $KMnO_4$ solution is equal to $5.8*10^{-4}$ mol. The mole ratio of $Cu^{+}$ to $Mn^{7+}$ is 5:1, so $5.8*10^{-4}$ was multiplied by 5 to obtain $2.9*10^{-3}$ mol $Cu^{+}$ (equal to the amount of CuCl moles). $2.9*10^{-3}$ multiplied by 99, the molar mass of CuCl, is equal to 0.2871 g. To determine the purity of CuCl in the sample, 0.2871 (the calculated mass of CuCl) was divided by 0.297 (the mass of the sample). (0.2871/0.297=0.967). The calculated purity of CuCl in the sample is 96.7%, which meets the American Chemical Society's highest standard.

At the experimental scale, the filter was dried in a microwave and the product was left on it for weighing because the quantity produced was so small that any losses would significantly impact measurements. The filter with the dried product on it was weighed, and after the product was removed the filter was weighed again. The empty filter weight was subtracted from the initial filter weight to get the yield. At the industrial level however, multiple changes could be made from the experimental procedure, which was not fully optimized due to resource limitations. The drying method would most likely be different—minor (non-proportional) losses are not expected to be significant at large scale, so the product could be spread out to dry faster. Additionally, drying could use solar or waste heat as they emit no additional GHGs and can be retrofitted into current manufacturing processes to use at large scale.

To compare GHG emissions from the Proposed Method with the emissions from other methods of producing CuCl, extensive research was conducted on the emissions from each reaction and raw materials used in four different methods and the total CO2 equivalent emissions were calculated. The methods compared were reduction of CuCl2 with SO2, comproportionation in acetone, the Main Industrial Method (direct combination of molten Cu metal with Cl2 gas), and a version of the Copper-Chlorine Cycle (which is an emerging method of hydrogen production) modified to produce Copper(I) Chloride (referred to as the Theoretical Future Method because it does not exist today). [FIG. 3].

Below is the calculation for the Proposed Method:

The Proposed Method has five major sources of GHG emissions: the raw materials copper, sodium chloride, and hydrochloric acid, and the processes of electrolysis and filtration. Below is the calculation for each source.

Copper production emits 4.1 g CO2 per gram Cu, and 30% of copper is recycled meaning copper acquisition emits an average of 2.9 g CO2 per gram Cu (4.1*0.7=2.9 g). During the testing of the Proposed Method, 0.786 g of copper was oxidized from the anode to produce 0.840 g of CuCl. Thus, the amount of copper needed to produce 1 g of CuCl by the Proposed Method is 0.936 g (0.786/0.84), accordingly, 2.7 g CO2/g CuCl in this method comes from copper (0.936*2.88=2.7 g CO2).

The method used to produce sodium chloride for industrial purposes is solar evaporation, which releases on average 4*10-2 g CO2 per gram. The Proposed Method uses 7 g of NaCl to produce 0.840 g CuCl, meaning 8.3 g (7/0.84) are needed to produce 1 g CuCl. In total 0.3 g CO2/g CuCl comes from sodium chloride (4*10-2*8.3=0.3 g CO2).

Renewable energy sources emit approximately 50 grams of CO2 per kWh of power. The Proposed Method uses 2.54*10-3 kWh (12V, 5.3*10-2 A, 4 h) to produce 0.840 g CuCl, meaning 3.0*10-3 kWh is needed to produce 1 g of CuCl. The total emissions from electrolysis are 0.1 g CO2/g CuCl (3.0*10-3*50=0.15 g CO2).

30% (9.45M) HCl production emits 1.2 g CO2 per gram. 50 mL of 0.1 M HCl are used for the production of 0.840 g CuCl, which equates to 0.5 g of 30% HCl (1.2 g/mL), or 0.6 g per gram CuCl (50*(0.1/9.45)*(1/0.840)). This emits 0.8 g CO2/g CuCl (0.63*1.2=0.8 g CO2).

Filtration uses 0.5 Kwh/$m^3$. Therefore, filtration of 60 mL of electrolysis solution is calculated to use 3×10-5 Kwh of power and hence emit 0.0015, or ~0 g CO2.

Therefore, the Proposed Method emits [2.7 g+0.3 g+0.1 g+0.8 g+0 g]=3.9 g CO2/g CuCl.

However, the Proposed Method also results in byproducts and unreacted reagents that can be collected and utilized. Because of this, the CO2 that would have been emitted from manufacturing the byproducts and unreacted reagents should be subtracted from the total value. The byproducts formed are CuCl2 and H2 gas, and the unreacted reagent left over is NaCl. Hydrogen is formed at the cathode from reduction of water, and CuCl2 is formed from the Cu2+ ions in solution. The CuCl2 and unreacted NaCl can be separated by saturating the solution with NaCl to precipitate out CuCl2. The resulting saturated NaCl solution can be reused by mixing with water to create a 2M solution, the CuCl2 can be packaged and sold like the main product, and the hydrogen can be burned with no emissions to generate some of the electricity to be used for electrolysis. A calculation of the emissions to be subtracted from the total follows.

CuCl2 is produced by the reaction of CuCO3 and HCl.

[CuCO3+2 HCl→CuCl2+CO2+H2O]

1 g (7.4*10-3 mol) of CuCl2 requires 0.9 g CuCO3 and 0.3 g HCl. The reaction itself also releases 0.3 g CO2/g CuCl2. CuCO3 production emits 2.0 g CO2/g, meaning that producing 0.9 g would emit 1.8 g CO2 (0.9*2). 30% HCl Production emits 1.2 g CO2/g, meaning production of the equivalent of 0.3 g pure HCl would emit 1.1 g CO2. In total, CuCl2 production emits 3.3 g CO2/g (0.3+1.2+1.0=3.3).

GHG emissions from NaCl production were already calculated earlier and emissions from hydrogen were not included since not enough is produced in the Proposed Method for any meaningful difference to be achieved by subtracting emissions from it.

As stated earlier, the Proposed Method uses 0.786 g Cu and produces 0.840 g CuCl. Based on the percent by mass of Cu in CuCl, 0.147 g of Cu remains in solution as CuCl2. Based on the percent by mass of Cu in CuCl2, 0.3 g of CuCl2 are formed. The total mass of chlorine in 0.840 g CuCl and 0.3 g CuCl2 is 0.5 g. The mass of chlorine in 7 g of NaCl is 4.3 g, meaning that 3.7 g of it (4.2-0.5) is left unreacted. Based on the percent by mass of C in NaCl, there are 6.1 g of unreacted NaCl left. The GHG emission coefficients for CuCl2 and NaCl were found earlier. Multiplying 6.1 by 4*10-2 and 0.3 by 3.3 results in a total value of 1.3 g CO2/g CuCl saved by extracting byproducts and unreacted reagents (1.0+0.3). Subtracting 1.3 from the calculated value for total GHG emissions per gram (3.9 g) results in 2.6 g. Thus, the total GHG emissions from CuCl production by the Proposed Method are equal to 2.6 g CO2/g CuCl.

Below is the calculation for SO2 reduction:

The SO2 reduction method involves the reaction of CuCl2 with SO2 in water

[2CuCl2+2H2O+SO2→2CuCl+2HCl+H2SO4]

For every gram of CuCl, this requires 0.3 g of SO2 (because of the 2:1 mole ratio of SO2 and CuCl), which is produced directly from burning fossil fuels and emits 551.9 g CO2/g. Hence, 176.6 g CO2/g CuCl are emitted from SO2 production alone. The remaining emissions come from the production of CuCl2, which is used as the copper source in this reaction rather than copper metal. CuCl2 is produced by the reaction of CuCO3 and HCl.

[CuCO3+2 HCl→CuCl2+CO2+H2O]

1 g of CuCl2 requires 0.9 g CuCO3 and 0.3 g HCl. The reaction itself also releases 0.3 g CO2/g CuCl2. CuCO3 production emits 2.0 g CO2/g, meaning that producing 0.9 g would emit 1.8 g CO2 (0.9*2). 30% HCl production emits 1.2 g CO2/g, meaning production of the equivalent of 0.3 g pure HCl would emit 1.1 g CO2 (0.3*1.2/0.3). In total, CuCl2 production emits 3.2 g CO2/g as calculated from (0.3 g+1.8 g+1.1 g). 1.3 g CuCl2 are needed for the reaction, hence CuCl2 production for this method emits 4.4 g CO2/g CuCl. Adding the emissions from SO2 and CuCl2, the SO2 reduction method emits 181.0 g CO2/g CuCl.

Below is the calculation for comproportionation in acetone:

The comproportionation method uses 5 mL of acetone per 2*10-3 g CuCl2 and 1*10-3 g Cu (3*10-3 g CuCl) (19). This would mean that 1.7 L of acetone are required to produce 1 g CuCl. This alone emits 3384.4 g CO2 because acetone production emits 2.6 g CO2/g (20), and combined with the other sources of emissions (CuCl2 and Cu Metal, described above), the total for this method is 3387.5 g CO2/g CuCl.

Below is the calculation for the Main Industrial Method:

The Main Industrial Method has four major sources of GHG Emissions: copper production, chlorine production, copper melting, and natural gas production.

Copper production emits 4.1 g CO2 per gram Cu, and 30% of copper is recycled meaning copper acquisition emits an average of 2.9 g CO2 per gram Cu (4.1*0.7=2.9). The calculation assumes 100% yield, meaning 0.6 g Cu is used to produce 1 g of CuCl (based on the Cu % by mass in CuCl), accordingly, in the Main Industrial Method 1.8 g CO2/g CuCl comes from copper (0.6*2.9=1.8 g).

Chlorine production emits 2.1 g CO2 per gram. The calculation assumes 100% yield, meaning 0.4 g Cl are used to produce 1 g of CuCl (based on the Cl % by mass in CuCl). In total 0.8 g CO2/g CuCl comes from chlorine (2.1*0.4=0.8 g).

In the Main Industrial Method, 3.3 g CO2/g CuCl comes from the acquisition and burning of natural gas. Based on its specific heat and heat of fusion, copper requires 615.1 Joules of energy per gram to melt it (assuming 100% efficiency in heating). Assuming 100% yield, the Main Industrial Method uses 0.6 g Cu to produce 1 g CuCl (based on the Cu % by mass in CuCl), meaning 393.6 J (0.6*615.1) are needed to melt it. 1 cubic foot of natural gas can be burned to produce 1.1*10^6 J of energy. Burning 1 cubic foot of gas emits 5.5*10−2 kg of CO2. This means 0.02 (393.6/1.1*10^*5.5*10−2*1000=0.02), or ~0 g CO2 are emitted from melting copper. Natural gas extraction emits 8.4 g of CO2 per megajoule. It was calculated that 393.6 Joules of energy from natural gas are used in the Main Industrial Method to produce 1 g of CuCl, meaning 3.3 g CO2 (8.4*390.6/1000=3.3) are emitted from natural gas acquisition. Therefore, the total GHG can be calculated as (1.8 g+0.8 g+0 g+3.3 g)=5.9 g CO2/g CuCl.

Heat loss and impurities increase the emissions of the listed steps of the Main Industrial Method, however their extent is unknown. Due to the lack of information, it is also unknown if there are more GHG-emitting steps in it. Notwithstanding the high likelihood of their existence, all the unknown emissions in the Main Industrial Method are not counted in this calculation. In total, the Main Industrial Method emits >5.9 g CO2/g CuCl.

Thus, the Main Industrial Method emits ~2.3 times the GHGs as the Proposed Method (2.6 g CO2/g CuCl). The SO2 Reduction Method and the Comproportionation Method emit orders of magnitude more GHGs than both the Main Industrial Method and the Proposed method.

Below is the calculation for the Theoretical Future Method:

The Theoretical Future Method consists of the following reactions:

$$[H_2O(g)+2CuCl_2(s)\rightarrow Cu_2OCl_2(s)+2HCl(g)]$$

$$[2Cu_2OCl_2(l)\rightarrow 4CuCl(l)+O_2(g)]$$

The first reaction takes place at 400° C. and the second reaction takes place at 530° C. There are three major sources of emissions in this method—Copper(II) chloride and two instances of heating—as well as one byproduct that can be utilized (HCl), which will be factored into the calculation in the same way that CuCl2 was in the Proposed Method.

Copper(II) chloride emissions were calculated in the Proposed Method section and are equal to 3.3 g CO2/g. 1.4 g are used, hence the total emissions from CuCl are 4.4 g CO2/g CuCl.

As of today, industrial processes are usually heated with natural gas, which emits significantly more GHGs than renewable energy sources, however, because this is an emerging method that might be used in the future, the emissions from heating are calculated assuming that renewable energy sources are used for electric heating. The following calculation thus represents the lowest possible emissions from this method. To produce 1 g of CuCl, the Theoretical Future Method requires 0.1 g H2O and 1.4 g CuCl2 to be heated to 400° C., and 1.1 g Cu2OCl2 to be heated from 400° C. to 530° C. In total, 800.5 J are needed (273.4 J for CuCl2, 141.4 J for H2O, 72.42 J for Cu2OCl2 (28), 110 J for CuCl melting, and 203.4 J for H2O vaporization). 800.5 J is equal to 2.2*10−4 kWh. Renewable sources of energy emit 50 g CO2/kWh, meaning that the heating process emits 0.01, or ~0 g CO2/g CuCl.

Gaseous HCl production emits 0.9 g CO2/g (13), and the Theoretical Future Method produces 0.4 g HCl for every gram of CuCl. This means that total emissions are reduced by 0.3 g CO2/g CuCl (0.9*0.4). The total emission therefore is calculated as (4.4 g+0 g −0.3 g=4.1 g CO2/g CuCl).

Since this method is not yet operational, it is impossible to accurately calculate heat loss. In this calculation, heat loss is assumed to be zero, however in reality, emissions from heat loss and similar sources would significantly increase total emissions. In total, according to this calculation the Theoretical Future Method emits >4.1 g CO2/g CuCl.

In summary, the Proposed Method was found to be the most sustainable, emitting ~2.6 g CO2/g CuCl. The Theoretical Future Method was found to emit >4.1 g CO2/g CuCl, and the most polluting of the three—the Main Industrial Method—was found to emit >5.9 g CO2/g CuCl.

The GHG emission calculations are meant to accurately represent emissions from industrial production using the Proposed Method, rather than from the experiments. Therefore, emissions from unit operations or factors that would be product agnostic and hence similar across methods on a per-gram crystalline product basis; on a large scale; such as drying, mixing, or pneumatic or hydraulic pressure creation for pumping and filtration; among others; are presumed to be similar across all the methods studied; as are emissions from comparable peripheral off-site operations such as logistics, transport and warehousing.

The invention claimed is:

1. A method of synthesizing Copper(I) chloride comprising the following steps:

a. contacting a copper (Cu) anode and a cathode with an electrolyte in an electrochemical cell wherein the electrolyte is a solution of a chloride-containing salt; applying voltage to the anode and the cathode; causing copper (Cu) from the anode to be oxidized into Cu+, which reacts with dissolved chloride (Cl−) and oxygen (O), thereby forming precipitates comprising Copper(I) chloride (CuCl) and Copper(I) oxide (Cu2O), along with impurities;

b. withdrawing the precipitates formed in step (a) from the electrochemical cell;

c. reaction of the precipitates formed in step (a), and withdrawn in step (b), with dilute hydrochloric acid, wherein impurities are dissolved, Copper(I) Oxide (Cu2O) is converted to Copper(I) chloride (CuCl) by a substitution reaction with HCl, and Copper(I) chloride (CuCl) remains intact; thereby converting the precipitates formed in step (a) and withdrawn in step (b) to a purified Copper(I) chloride precipitate;

d. withdrawing the purified Copper(I) chloride precipitate formed in step (c) from the dilute hydrochloric acid.

2. The method of claim 1 wherein the chloride-containing salt in step (a) is sodium chloride.

3. The method of claim 1 wherein the concentration of the chloride-containing salt in step (a) is 2 M.

4. The method of claim 1 wherein the voltage applied in step (a) is 12 volts.

5. The method of claim 1 wherein the voltage is applied for 4 hours in step (a).

6. The method of claim 1 wherein the concentration of the dilute hydrochloric acid in step (c) is 0.1 M.

7. The method of claim 1 wherein all of the steps are performed at room temperature.

8. The method of claim 1 wherein the cathode in step (a) comprises graphite.

9. The method of claim 1 wherein withdrawal of precipitates in steps (b) and (d) is accomplished using filtration.

10. A method of synthesizing Copper(II) chloride comprising the following steps:

a. contacting a copper (Cu) anode and a cathode with an electrolyte in an electrochemical cell wherein the electrolyte is a solution of a chloride-containing salt; applying voltage to the anode and the cathode; causing copper (Cu) from the anode to be oxidized into Cu+, which reacts with dissolved chloride (Cl−) and oxygen (O), thereby forming precipitates comprising Copper(I) chloride (CuCl) and Copper(I) oxide (Cu2O), along with impurities;

b. withdrawing the precipitates formed in step (a) from the electrochemical cell;

c. saturating the electrolyte from step (a) with the same chloride-containing salt it is a solution of after the precipitate formed in step (a) is withdrawn, thereby forming a precipitate comprising Copper(II) chloride;

d. withdrawing the Copper(II) chloride precipitate formed in step (c) from the electrolyte.

11. The method of claim 10 wherein the chloride-containing salt in step (a) is sodium chloride.

12. The method of claim 10 wherein the concentration of the chloride-containing salt in step (a) is 2 M.

13. The method of claim 10 wherein the voltage applied in step (a) is 12 volts.

14. The method of claim 10 wherein the voltage is applied for 4 hours in step (a).

15. The method of claim 10 wherein all of the steps are performed at room temperature.

16. The method of claim 10 wherein the cathode in step (a) comprises graphite.

17. The method of claim 10 wherein withdrawal of precipitates in steps (b) and (d) is accomplished using filtration.

* * * * *